US011291313B2

(12) United States Patent
Weshler et al.

(10) Patent No.: US 11,291,313 B2
(45) Date of Patent: Apr. 5, 2022

(54) LIGHTING APPARATUS AND SYSTEM FOR COSMETIC DISPLAYS

(71) Applicant: DSI Group Inc, Maspeth, NY (US)

(72) Inventors: Benjamin S. Weshler, Maspeth, NY (US); Yin-Chie Huang, Maspeth, NY (US); Anthony DeMayo, Maspeth, NY (US)

( * ) Notice: Subject to any disclaimer, the term of this patent is extended or adjusted under 35 U.S.C. 154(b) by 30 days.

(21) Appl. No.: 17/007,894

(22) Filed: Aug. 31, 2020

(65) Prior Publication Data

US 2021/0120978 A1 Apr. 29, 2021

Related U.S. Application Data

(60) Provisional application No. 62/893,419, filed on Aug. 29, 2019.

(51) Int. Cl.
*F21V 21/35* (2006.01)
*A47F 5/00* (2006.01)

(52) U.S. Cl.
CPC ..... *A47F 5/0025* (2013.01); *A47F 5/0043* (2013.01); *A47B 2220/0077* (2013.01); *F21V 21/35* (2013.01)

(58) Field of Classification Search
CPC combination set(s) only.
See application file for complete search history.

(56) References Cited

U.S. PATENT DOCUMENTS 4,414,617 A * 11/1983 Galindo ..... H01R 25/14 362/150
6,588,920 B2 * 7/2003 Agro ..... F21S 8/06 362/287

* cited by examiner

*Primary Examiner* — Vip Patel
(74) *Attorney, Agent, or Firm* — Tarter Krinsky & Drogin LLP

(57) ABSTRACT

Exemplary embodiments of a lighting apparatus and system for cosmetic displays is provided. For example, a display shelf is provided including a support structure having a bottom wall and a side wall, an elongated power track having a length approximately a same length as the side wall, the elongated power track configured to be slidably received within the side wall of the support structure, and a power conductor rail provided in the elongated power track extending along the length of the power track configured to provide power to a modular housing. The modular housing includes a plunge contact that connects to the elongated power track to provide power to lighting within the modular housing.

20 Claims, 2 Drawing Sheets

LIGHTING APPARATUS AND SYSTEM FOR COSMETIC DISPLAYS

CROSS-REFERENCE TO RELATED APPLICATIONS

This application relates to and claims priority from U.S. Provisional Patent Application Ser. No. 62/893,419 filed Aug. 29, 2019, the entire disclosure of which is hereby incorporated herein by reference.

FIELD OF THE DISCLOSURE

The present disclosure relates to exemplary embodiments of a lighting apparatus and system, and more particularly, to exemplary embodiments of a lighting apparatus and system for cosmetic displays.

BACKGROUND INFORMATION

Shelving is commonly used to display merchandise, with the shelving typically positioned and dimensioned to maximize the amount of merchandise displayed in any given area of floor space while allowing shoppers to easily view the merchandise. Commonly, merchants want to provide some type of lighting to make the products appear more desirable. Often, this leads to messy wiring in the shelves or housing unit provided in the shelf and prevents movement of individual units that require wiring behind the shelf.

It would be beneficial to provide a lighting system that allowed free movement of individual housing units in the shelves without concern for the wiring needed in the back of each of the housing units.

SUMMARY OF EXEMPLARY EMBODIMENTS OF THE DISCLOSURE

Exemplary embodiments of the present disclosure can provide for a display shelf comprising a support structure having a bottom wall and a side wall, an elongated power track having a length approximately a same length as the side wall, the elongated power track configured to be slidably received within the side wall of the support structure, and a power conductor rail provided in the elongated power track extending along the length of the power track configured to provide power to a modular housing.

In some exemplary embodiments, the power conductor rail can comprise a positive conductor rail extending along the length of the elongated power track, and a negative conductor rail extending parallel to the positive conductor rail. The display shelf can further comprise a non-conductive portion provided between the positive conductor rail and negative conductor rail, and extending parallel to the positive conductor rail and negative conductor rail. The power track can further comprise an upper non-conductive portion and a lower non-conductive portion extending along the length of the elongated power track surrounding the positive and negative conductor rails.

In some exemplary embodiments, the display shelf can further comprise one or more clips provided on the side wall for retaining the elongated power track. The one or more clips can comprise a top clip for retaining the upper non-conductive portion and a bottom clip for retaining the lower non-conductive portion of the power track. The top clip can include a downward projection for retaining the upper non-conductive portion and the bottom clip can include an upward projection for retaining the lower non-conductive portion.

In some exemplary embodiments, the display shelf can further comprise wiring connected to the positive and negative conductor rails that extends behind the side wall. The display shelf can further comprise one or more shelving clips provided behind the side wall for hanging the support structure. The display shelf can further comprise a T-shaped top support provided on the support structure configured to retain a modular housing.

Exemplary embodiments of the present disclosure can also provide for a display system, comprising a support structure having a bottom wall and a side wall, a modular housing configured to hold one or more products and having a plunge contact provided at an outer portion thereof, the modular housing being supported by the support structure, and an elongated power track provided along a length of the side wall, the elongated power track configured to connect to the plunge contact and provide power to the modular housing.

In some exemplary embodiments, the elongated power track can be slidably received within the side wall of the support structure. In some exemplary embodiments, the plunge contact is provided in the rear portion of the modular housing, and a bottom portion of the modular housing is supported by the bottom wall. In some exemplary embodiments, the display system further comprises one or more mechanical fasteners provided on the rear portion of the modular housing for engagement with a T-shaped top support provided on the support structure to retain the modular housing to the support structure.

In some exemplary embodiments, the display system further comprises a power conductor rail provided in the elongated power track extending along the length of the power track configured to provide power to the plunge contact of the modular housing. The power conductor rail can further comprise a positive conductor rail extending along the length of the elongated power track configured to connect to a positive terminal of the plunge contact, and a negative conductor rail extending parallel to the positive conductor rail configured to connect to a negative terminal of the plunge contact. In some exemplary embodiments, the display system can further comprise a non-conductive portion provided between the positive conductor rail and negative conductor rail, and extending parallel to the positive conductor rail and negative conductor rail, and an upper non-conductive portion and a lower non-conductive portion extending along the length of the elongated power track surrounding the positive and negative conductor rails.

In some exemplary embodiments, the display system can further comprise one or more clips provided on the side wall for retaining the elongated power track, wherein the one or more clips comprise a top clip for retaining the upper non-conductive portion and a bottom clip for retaining the lower non-conductive portion of the power track, the top clip including a downward projection for retaining the upper non-conductive portion and the bottom clip including an upward projection for retaining the lower non-conductive portion. In some exemplary embodiments, the display system can further comprise wiring connected to the elongated power track that extends behind the side wall. In some exemplary embodiments, the display system can further comprise one or more shelving clips provided behind the side wall for hanging the support structure.

BRIEF DESCRIPTION OF THE DRAWINGS

The foregoing and other objects of the present disclosure will be apparent upon consideration of the following detailed description, taken in conjunction with the accompanying drawings, and claims, in which like reference characters refer to like parts throughout, and in which:

Figure 1:
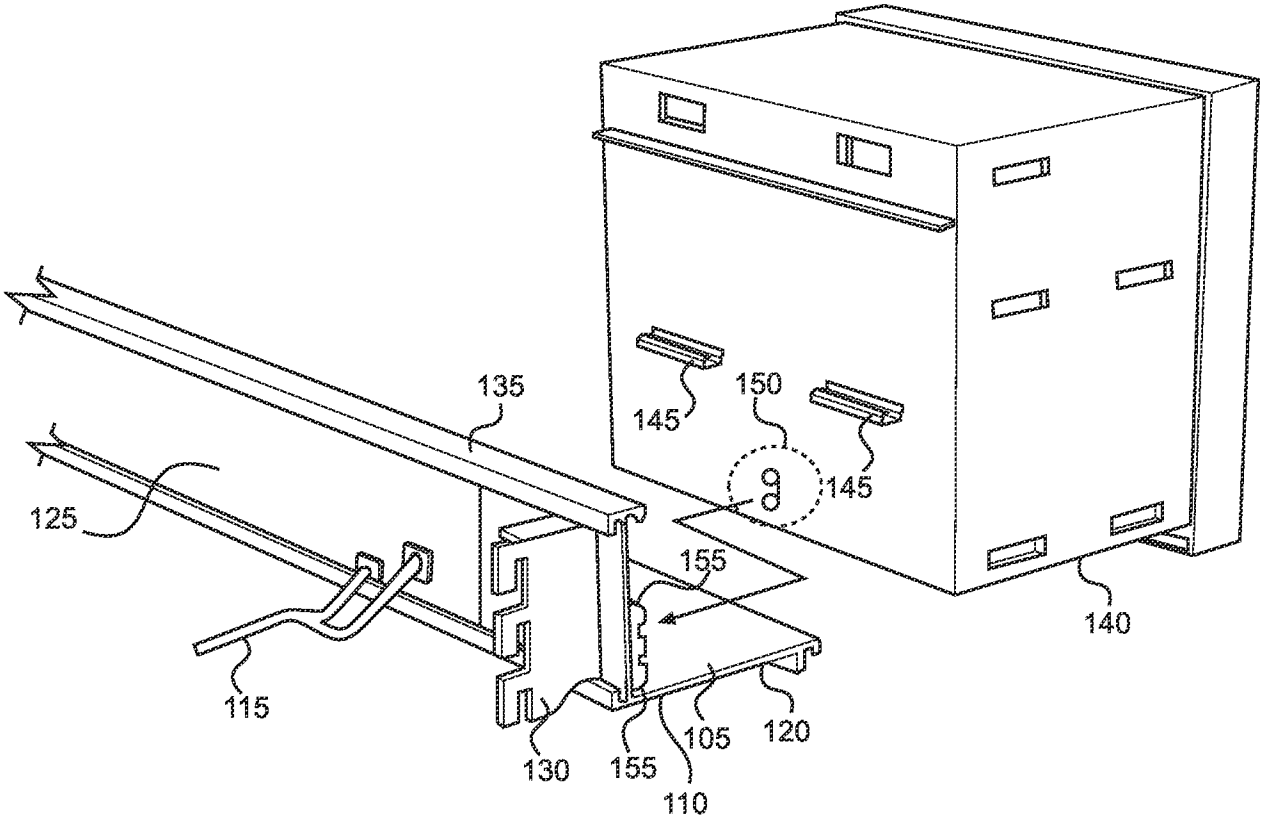
FIG. 1 is a rear perspective view of a lighting system and apparatus for a cosmetic display according to an exemplary embodiment of the present disclosure.

Throughout the figures, the same reference numerals and characters, unless otherwise stated, are used to denote like features, elements, components or portions of the illustrated embodiments. Moreover, while the subject disclosure will now be described in detail with reference to the figures, it is done so in connection with the illustrative embodiments. It is intended that changes and modifications can be made to the described embodiments without departing from the true scope and spirit of the subject disclosure.

DETAILED DESCRIPTION OF EXEMPLARY EMBODIMENTS OF DISCLOSURE

Exemplary embodiments of the various methods and apparatuses will now be described with reference to the figures. The following description of the various embodiments is merely exemplary in nature and is in no way intended to limit the scope of the disclosure, its application, or uses.

Figure 2:
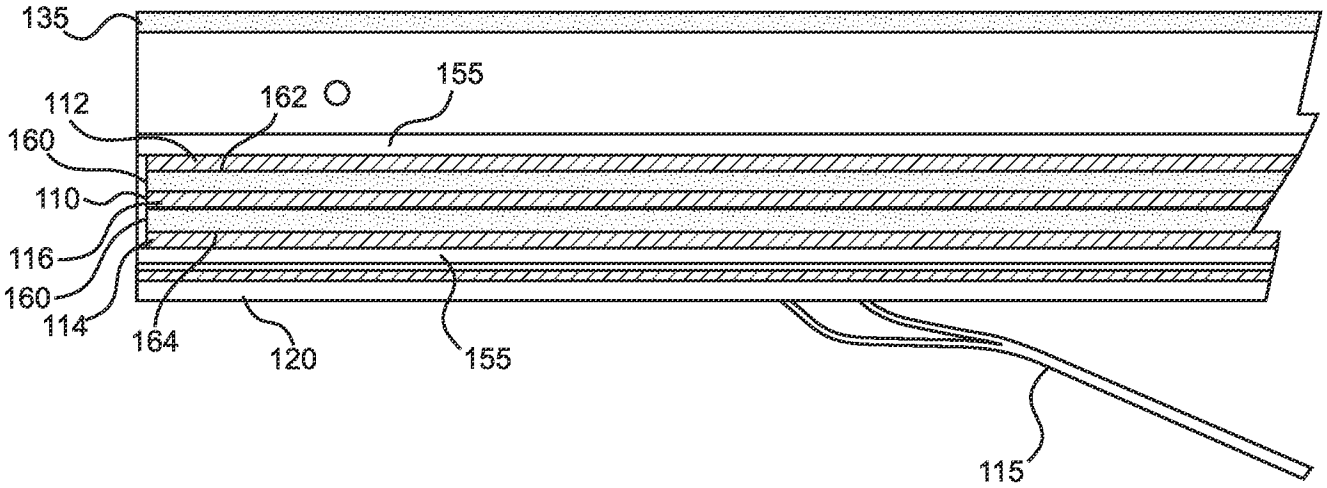
FIG. 2 is a front perspective view of a lighting system and apparatus for a cosmetic display according to an exemplary embodiment of the present disclosure.

FIGS. 1 and 2 are illustrations of a lighting system and apparatus for cosmetic displays according to exemplary embodiments of the present disclosure. For example, as seen in FIG. 1, a power track 110 can be provided on a support structure 120 (e.g., display shelf), which can be made of aluminum. Wiring 115 on the back of the power track 110 can be connected to the power track 110 as shown in FIG. 1 to provide power to the power track 110 from, e.g., a transformer (not shown). The support structure 120 can have shelving clips 130 (e.g., on opposite ends) to allow the support structure 120 to hang on, e.g., a cosmetic display rack (not shown).

The power track 110 can slidably fit within the support structure 120. In some exemplary embodiments, the power track 110 can be elongated and have a length approximately the same length as the back wall 125 of the support structure 120. The power track 110 can be provided on a back wall 125 of the support structure 120. For example, the power track 110 can have upper and lower portions 112, 114 that slidably fit within clips 155 provided on a back wall 125 of the support structure 120. The bottom and top clips 155 can have upward and downward projections, respectively, to retain the upper and lower portions 112, 114 of the power track 110 to securely hold the power track 110 along the back wall 125 of the support structure 120. The power track 110 can also be provided on a bottom or top wall of the support structure 210 (which would correspond to a plunge contact of the modular housing) and is not limited to a back wall 125. The power track 110 can slidably fit within the support structure 120 to provide power outlets for individual modular housings 140, as will be described below.

One or more modular housings 140 that hold cosmetic or other retail products can be provided on the support structure 120. The modular housings 140 can sit on the support structure 120 (e.g., a bottom wall 105) and can have mechanical connections to connect to the support structure 120. For example, the modular housing 140 can have mechanical fasteners 145 with hook-shape elements that fit or slide within a recess provided in the T-shaped top support 135 of the support structure 120, as shown in FIG. 1. The modular housing 140 can thus slide into the support structure 120, and the mechanical fasteners 145 can secure the modular housing 140 to the support structure 120.

The modular housing 140 can have a plunge contact 150 (having positive and negative terminals) that connect to the power conductor rail 160 of the power track 110. For example, as shown in FIG. 2, when the modular housing 140 is slidably fit into the support structure 120, the positive and negative terminals of the plunge contact 150 of the modular housing 140 can connect to the positive conductor rail 162 and the negative conductor rail 164 of the power conductor rail 160 to provide power from the power track 110 to the modular housing 140. The positive conductor rail 162 and the negative conductor rail can run parallel to each other, and a middle non-conductive portion 116 (e.g., an electrical insulator) of the power track 110 can separate the positive conductor rail 162 and the negative conductor rail 164 of the power conductor rail 160. The upper portion 112 and lower portion 114 can be non-conductive (e.g., an electrical insulator) as well. The positive conductor rail 162 and the negative conductor rail 164 of the power conductor rail 160 can provide power for various lighting in the modular housing 140, such as LED or other lighting, which can be internal of the housing 140 or along a border of the housing 140 to provide lighting for one or more products placed within the modular housing 140 or any indicia placed therein.

The power track 110 can be provided along approximately an entire length of the support structure 120, which can provide power to numerous modular housings 140 on that row. The power track 110 can include numerous power conductor rails 160 that can provide for terminals to connect to plunge contacts 160 of several modular housings 140, so that each of the modular housings 140 can receive power from the power track 110. This can avoid connecting wiring to each individual housing 140 or positioning of the housing 140 because of the wiring, as the modular housing can be slid anywhere on the row with power being conducted thereto. The support structures 120 can have various lengths, and numerous power tracks 110 and support structures can be provided for a cosmetic display, so a cosmetic display can have several rows of modular housings 140, each row corresponding to a support structure 120 and a power track 110 therein. Each row of shelving can have an individual power track 110 corresponding to the length of each support structure 120 provided within the cosmetic display, wherein the power track 110 provides power to all of the modular housings 140 within that row.

The exemplary embodiments of the present application are not limited to any number or location of the support structures, power tracks and modular housings. The support structures can have various lengths and sizes, and the power track 110 can be adjusted accordingly. The modular housings can also have various sizes, such as different lengths, widths and heights, and the support structure and power track can be adjusted accordingly to provide power to each of the modular housings. Various lighting can be provided on the modular housing, such as within the housing or the border of the housing as may be needed for different products provided within the modular housings.

Various other considerations can also be addressed in the exemplary applications described according to the exemplary embodiments of the present disclosure. For example, various materials may be used to construct the elements described in the figures, and various sizes and dimensions of the elements can be provided.

The foregoing merely illustrates the principles of the disclosure. Various modifications and alterations to the described embodiments will be apparent to those skilled in the art in view of the teachings herein. It will thus be appreciated that those skilled in the art will be able to devise numerous systems, arrangements, manufacture and methods which, although not explicitly shown or described herein, embody the principles of the disclosure and are thus within the spirit and scope of the disclosure.

What is claimed is:

1. A display shelf, comprising:

a support structure having a bottom wall and a side wall;

an elongated power track having a length approximately a same length as the side wall, the elongated power track configured to be slidably received within the side wall of the support structure; and a power conductor rail provided in the elongated power track extending along the length of the power track configured to provide power to a modular housing.

2. The display shelf of claim 1, wherein the power conductor rail comprises:

a positive conductor rail extending along the length of the elongated power track; and a negative conductor rail extending parallel to the positive conductor rail.

3. The display shelf of claim 2, further comprising:

a non-conductive portion provided between the positive conductor rail and negative conductor rail, and extending parallel to the positive conductor rail and negative conductor rail.

4. The display shelf of claim 3, wherein the power track further comprises:

an upper non-conductive portion and a lower non-conductive portion extending along the length of the elongated power track surrounding the positive and negative conductor rails.

5. The display shelf of claim 4, further comprising:

one or more clips provided on the side wall for retaining the elongated power track.

6. The display shelf of claim 5, wherein the one or more clips comprise a top clip for retaining the upper non-conductive portion and a bottom clip for retaining the lower non-conductive portion of the power track.

7. The display shelf of claim 6, wherein the top clip includes a downward projection for retaining the upper non-conductive portion and the bottom clip includes an upward projection for retaining the lower non-conductive portion.

8. The display shelf of claim 1, further comprising:

wiring connected to the positive and negative conductor rails that extends behind the side wall.

9. The display shelf of claim 1, further comprising:

one or more shelving clips provided behind the side wall for hanging the support structure.

10. The display shelf of claim 1, further comprising:

a T-shaped top support provided on the support structure configured to retain a modular housing.

11. A display system, comprising:

a support structure having a bottom wall and a side wall;

a modular housing configured to hold one or more products and having a plunge contact provided at an outer portion thereof, the modular housing being supported by the support structure; and an elongated power track provided along a length of the side wall, the elongated power track configured to connect to the plunge contact and provide power to the modular housing.

12. The display system of claim 11, wherein the elongated power track is slidably received within the side wall of the support structure.

13. The display system of claim 11, wherein the plunge contact is provided in the rear portion of the modular housing, and a bottom portion of the modular housing is supported by the bottom wall.

14. The display system of claim 13, further comprising:

one or more mechanical fasteners provided on the rear portion of the modular housing for engagement with a T-shaped top support provided on the support structure to retain the modular housing to the support structure.

15. The display system of claim 11, further comprising:

a power conductor rail provided in the elongated power track extending along the length of the power track configured to provide power to the plunge contact of the modular housing.

16. The display system of claim 15, wherein the power conductor rail comprises:

a positive conductor rail extending along the length of the elongated power track configured to connect to a positive terminal of the plunge contact; and a negative conductor rail extending parallel to the positive conductor rail configured to connect to a negative terminal of the plunge contact.

17. The display system of claim 16, further comprising:

a non-conductive portion provided between the positive conductor rail and negative conductor rail, and extending parallel to the positive conductor rail and negative conductor rail; and an upper non-conductive portion and a lower non-conductive portion extending along the length of the elongated power track surrounding the positive and negative conductor rails.

18. The display system of claim 17, further comprising:

one or more clips provided on the side wall for retaining the elongated power track, wherein the one or more clips comprise a top clip for retaining the upper non-conductive portion and a bottom clip for retaining the lower non-conductive portion of the power track, the top clip including a downward projection for retaining the upper non-conductive portion and the bottom clip including an upward projection for retaining the lower non-conductive portion.

19. The display system of claim 11, further comprising:

wiring connected to the elongated power track that extends behind the side wall.

20. The display system of claim 11, further comprising:

one or more shelving clips provided behind the side wall for hanging the support structure.

* * * * *